US010242537B2

(12) United States Patent
Morin et al.

(10) Patent No.: US 10,242,537 B2
(45) Date of Patent: Mar. 26, 2019

(54) CARD GAME WITH FIXED STARTING VALUE

(71) Applicant: Las Vegas Sands Corp., Las Vegas, NV (US)

(72) Inventors: Kelvin Morin, Las Vegas, NV (US); Andrew MacDonald, Singapore (SG)

(73) Assignee: Las Vegas Sands Corp., Las Vegas, NV (US)

( * ) Notice: Subject to any disclaimer, the term of this patent is extended or adjusted under 35 U.S.C. 154(b) by 98 days.

(21) Appl. No.: 15/379,399

(22) Filed: Dec. 14, 2016

(65) Prior Publication Data

US 2017/0178458 A1 Jun. 22, 2017

Related U.S. Application Data

(60) Provisional application No. 62/269,055, filed on Dec. 17, 2015.

(51) Int. Cl.

| | |
|---|---|
| ***G07F 17/32*** | (2006.01) |
| ***A63F 1/00*** | (2006.01) |
| ***A63F 3/00*** | (2006.01) |

(52) U.S. Cl.

CPC ..... *G07F 17/3293* (2013.01); *A63F 1/00* (2013.01); *A63F 3/00157* (2013.01); *G07F 17/3288* (2013.01); *A63F 2001/003* (2013.01)

(58) Field of Classification Search

USPC ..... 463/12, 13

See application file for complete search history.

(56) References Cited

U.S. PATENT DOCUMENTS

| | | | | |
|---|---|---|---|---|
| 5,577,731 | A | 11/1996 | Jones | |
| 5,615,888 | A | 4/1997 | Lofink et al. | |
| 6,206,373 | B1 | 3/2001 | Garrod | |
| 6,719,291 | B1 | 4/2004 | deKeller | |
| 2003/0222400 | A1 | 12/2003 | Collins et al. | |
| 2004/0256802 | A1 | 12/2004 | Centrone | |
| 2005/0073100 | A1 | 4/2005 | Falciglia | |
| 2007/0241503 | A1 | 10/2007 | Kling et al. | |
| 2007/0241505 | A1 | 10/2007 | Kling et al. | |
| 2008/0067745 | A1 | 3/2008 | Wikstrom | |
| 2008/0139274 | A1 * | 6/2008 | Baerlocher | G07F 17/32 463/16 |
| 2009/0256313 | A1 | 10/2009 | McGurk et al. | |
| 2011/0300918 | A1 | 12/2011 | Sparago | |
| 2012/0098198 | A1 | 4/2012 | Morris | |

(Continued)

*Primary Examiner* — Pierre E Elisca

(74) *Attorney, Agent, or Firm* — Lewis Roca Rothgerber Christie LLP

(57) ABSTRACT

In a card game between a dealer and at least one player, a fixed starting value is presented on a game table before cards are dealt. The game table includes one or more predesignated areas on which the fixed starting value is presented. One or more player cards are dealt to the at least one player, the one or more player cards having respective card values which, when added together with the fixed starting value, determine a point total for the at least one player. One or more dealer cards are dealt to the dealer, the one or more dealer cards having respective card values which, when added together with the fixed starting value, determine a point total for the dealer. A game outcome is determined based on at least one of the point total for the at least one player or the point total for the dealer.

20 Claims, 6 Drawing Sheets

(56) References Cited

U.S. PATENT DOCUMENTS

| | | | | |
|---|---|---|---|---|
| 2012/0252548 | A1 | 10/2012 | Love | |
| 2012/0276986 | A1* | 11/2012 | Baerlocher | G07F 17/32 463/25 |
| 2013/0310129 | A1* | 11/2013 | Baerlocher | G07F 17/32 463/17 |
| 2014/0206431 | A1* | 7/2014 | Baerlocher | G07F 17/32 463/20 |
| 2014/0213334 | A1 | 7/2014 | Au-Yeung | |
| 2014/0248932 | A1 | 9/2014 | Rudd et al. | |
| 2015/0243139 | A1 | 8/2015 | Mendicino | |

* cited by examiner

CARD GAME WITH FIXED STARTING VALUE

CROSS-REFERENCE TO RELATED APPLICATION

The present application claims the benefit of priority under 35 U.S.C. § 119 from U.S. Provisional Patent Application Ser. No. 62/269,055, filed on Dec. 17, 2015, which is hereby incorporated by reference in its entirety for all purposes.

BACKGROUND

Twenty-one is a comparing card game between a player and dealer. It is played with one or more decks of 52 cards. The object in the traditional game of twenty-one is to beat the dealer in one of the following ways: (i) get 21 points on the player's first two cards (called a blackjack), without a dealer blackjack; (ii) reach a final score higher than the dealer without exceeding 21; (iii) or let the dealer draw additional cards until his or her hand exceeds 21.

SUMMARY

The disclosed subject matter relates to a method of playing a card game between a dealer and at least one player. The method comprises presenting a fixed starting value on a game table before cards are dealt, the game table comprising one or more predesignated areas on which the fixed starting value is presented. The method further comprises dealing one or more player cards to the at least one player, the one or more player cards having respective card values which, when added together with the fixed starting value, determine a point total for the at least one player. The method further comprises dealing one or more dealer cards to the dealer, the one or more dealer cards having respective card values which, when added together with the fixed starting value, determine a point total for the dealer, and determining a game outcome based on at least one of the point total for the at least one player or the point total for the dealer.

The disclosed subject matter also relates to a system for playing a virtual card game. The system comprises a display device, one or more processors, and a machine-readable medium comprising instructions stored therein, which when executed by the processors, cause the processors to perform operations comprising displaying a graphical interface on the display device, the graphical interface comprising a virtual game table. The operations further comprise presenting a fixed starting value on the virtual game table before virtual cards are dealt, the virtual game table comprising one or more predesignated areas on which the fixed starting value is presented, and dealing one or more virtual player cards to a player, the one or more virtual player cards having respective card values which, when added together with the fixed starting value, determine a point total for the player. The operations further comprise dealing one or more virtual dealer cards to a virtual dealer, the one or more virtual dealer cards having respective card values which, when added together with the fixed starting value, determine a point total for the virtual dealer, and determining a game outcome based on at least one of the point total for the player or the point total for the virtual dealer.

It is understood that other configurations of the subject technology will become readily apparent from the following detailed description, where various configurations of the subject technology are shown and described by way of illustration. As will be realized, the subject technology is capable of other and different configurations and its several details are capable of modification in various other respects, all without departing from the scope of the subject technology. Accordingly, the drawings and detailed description are to be regarded as illustrative in nature and not as restrictive.

BRIEF DESCRIPTION OF THE DRAWINGS

Certain features of the subject technology are set forth in the appended claims. However, for purpose of explanation, several implementations of the subject technology are set forth in the following figures.

DETAILED DESCRIPTION

Figure 1:
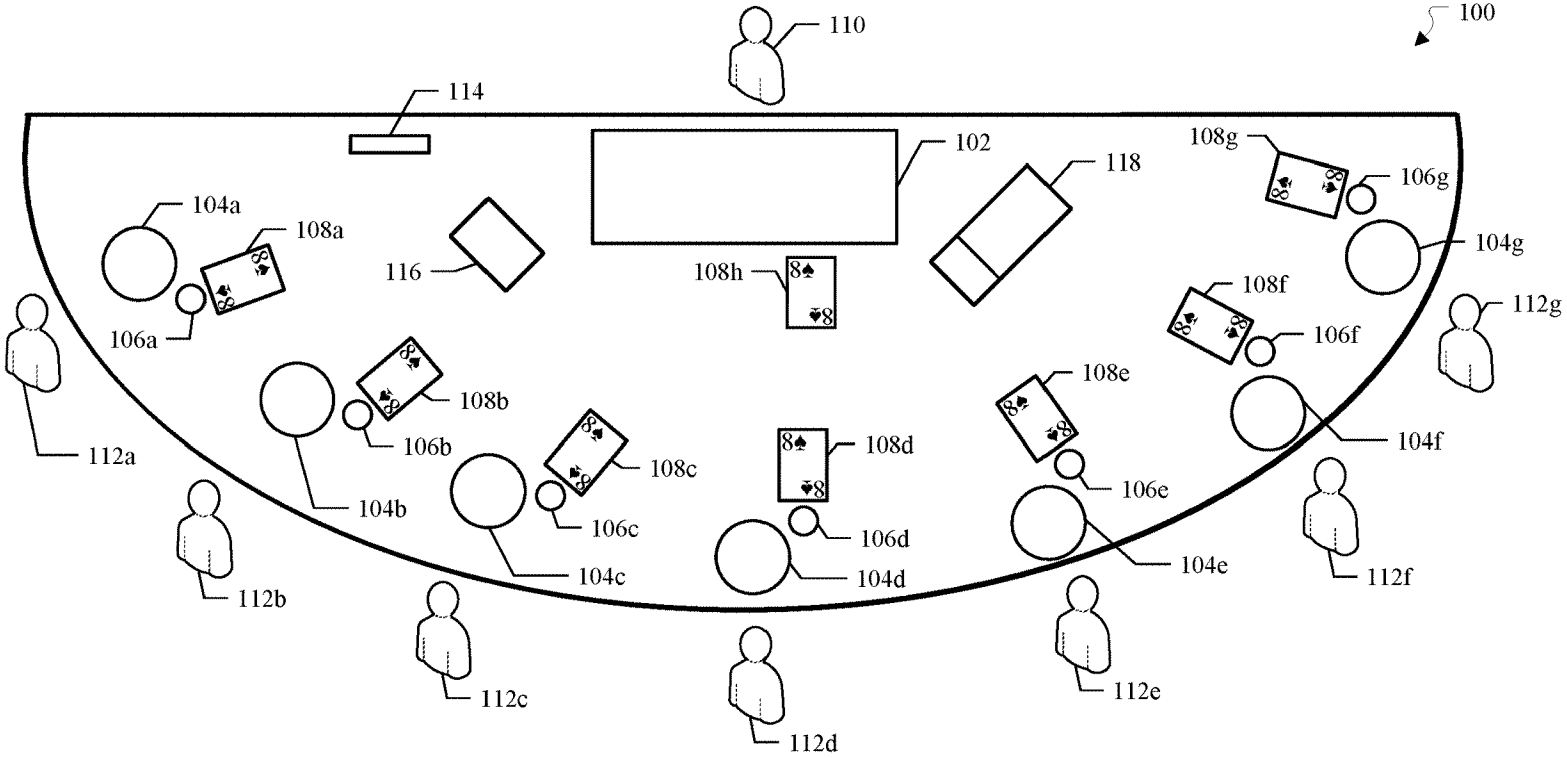
FIG. 1 illustrates an example of a game table for playing a card game between a dealer and at least one player.

The detailed description set forth below is intended as a description of various configurations of the subject technology and is not intended to represent the only configurations in which the subject technology may be practiced. The appended drawings are incorporated herein and constitute a part of the detailed description. The detailed description includes specific details for the purpose of providing a thorough understanding of the subject technology. However, it will be clear and apparent that the subject technology is not limited to the specific details set forth herein and may be practiced without these specific details.

As noted above, twenty-one is a comparing card game between a player and dealer. It is played with one or more decks of 52 cards. The object in the traditional game of twenty-one is to beat the dealer in one of the following ways: (i) get 21 points on the player's first two cards (called a blackjack), without a dealer blackjack; (ii) reach a final score higher than the dealer without exceeding 21; (iii) or let the dealer draw additional cards until his or her hand exceeds 21.

In traditional twenty-one, the player or players are dealt a two-card hand and add together the value of their cards. Face cards (Kings, Queens and Jacks) are counted as ten points. A player and the dealer count an Ace as 1 point or 11 points. All other cards are counted as the numeric value shown on the card. After receiving their first two cards, players have the option to "hit," or take an additional card. In a given round, the player or the dealer wins by having a score of 21 or by having the higher score that is less than 21. Scoring higher than 21 (called "busting" or "going bust") results in a loss. A player may win by having any final score equal to or less than 21 if the dealer busts. If the player and dealer have the same total, this is called a "push," and the player typically does not win or lose money on that hand.

If a player holds an Ace valued as 11, the hand is called "soft," meaning that the player cannot bust by taking an additional card; 11 plus the value of any other card will always be less than or equal to 21. Otherwise, the hand is "hard." The dealer must hit until his/her cards total 17 or more points. In some versions of twenty-one, the dealer also hits on a "soft" 17, i.e., a hand containing an Ace and one or more other cards totaling six.

In example aspects, the subject disclosure provides for playing a live version of twenty-one between a dealer and at least one player. In the subject card game, a fixed starting value (e.g., the 8 of spades) is presented on a game table (e.g., permanently imprinted on the game table or displayed on display device(s) integrated into the game table) before cards are dealt. The game table includes one or more predesignated areas (e.g., corresponding to positions of the dealer and each player) on which the fixed starting value is presented. One or more player cards are dealt to the at least one player, the one or more player cards having respective card values which, when added together with the fixed starting value, determine a point total for the at least one player. One or more dealer cards are dealt to the dealer, the one or more dealer cards having respective card values which, when added together with the fixed starting value, determine a point total for the dealer. A game outcome is determined based on at least one of the point total for the at least one player or the point total for the dealer.

In addition to the live version of the subject card game, the disclosure provides for an electronic version in which a live player interacts with a display device, to play a virtual game against a virtual dealer. In particular, a system displays a graphical interface on the display device, the graphical interface comprising a virtual game table. A fixed starting value (e.g., the 8 of spades) is presented on the virtual game table before virtual cards are dealt, the virtual game table comprising one or more predesignated areas on which the fixed starting value is presented. One or more virtual player cards are dealt to the player, the one or more virtual player cards having respective card values which, when added together with the fixed starting value, determine a point total for the player. One or more virtual dealer cards are dealt to the virtual dealer, the one or more virtual dealer cards having respective card values which, when added together with the fixed starting value, determine a point total for the virtual dealer. A game outcome is determined based on at least one of the point total for the player or the point total for the virtual dealer.

The term "game" or "games" as used herein encompasses various opportunities for a player to wager on the results or outcome of an event, and/or on a specific occurrence. For example, wagering may occur in games such in a card game in which the event may be a dealing and/or revealing of one or more cards to the player(s), the opponent (e.g., dealer), or both. The outcome may be associated with odds that the cards will be dealt in one of multiple combinations to a player, the opponent, or both, and further may be associated with a payout payable on the occurrence of the wagered event. In one example, the payout may be calculated based on the amount of the bet and/or the odds. Odds of winning the wager and/or the payout of a wager placed on a game may be dependent on or independent from the number of players in the game. In one example, any number of players wagering on the game may be personally located at the game according to the processes described herein.

The following terms are also described in accordance with example aspects of the subject card game: "double" corresponds to increasing a wager by up to or equal the amount of the original wager but the increase must not be less than the table minimum; "hand" corresponds to the cards that have been dealt to a player or to the dealer in a round of play; "hard total" corresponds to the point total of a hand either without an Ace or with an Ace or Aces that are counted as 1 point in value; "initial deal" corresponds to only the first card to the player having been dealt, but no further cards having been taken or wagers acted upon; "pair" corresponds to the first card dealt to the player matching the fixed starting value (e.g., 8); "point total" corresponds to the total points of cards in a hand which may include the permanent card (e.g., 8); "round of play" corresponds to the period of play commencing with the commencement of play and concluding when the dealer announces a result and, if applicable, collecting losing wagers and paying winning wagers; "soft total" corresponds to the point total of a hand containing at least an Ace that is counted as 11 in value without exceeding 21; "split" or "splitting" corresponds to splitting any two matching cards (e.g., 8's); "stand-off" corresponds to a wager that neither wins nor loses; "subsequent deal" corresponds to additional cards requested by the player(s) after the initial deal; "surrender" corresponds to a player giving up 50 percent of the original wager to fold the hand after the initial deal; "6-7-8 bonus" corresponds to a bet being paid a bonus on the original main wager, regardless of the outcome of the hand, if the first two cards drawn to the player's hand are a 6-card and a 7-card.

FIG. 1 illustrates an example of a game table for playing a card game between a dealer and at least one player. As shown in FIG. 1, game table 100 includes a chip tray 102 and fixed starting value 108*h* corresponding to dealer position 110, from which the dealer deals the card game. Game table further includes starting values 108*a-g*, main wager areas 104*a-g* and side wager areas 106*a-g*, each of which respectively correspond with player positions 112*a-g*, each of which play against the dealer. Game table 100 further includes a minimum bet sign 114, a discard rack 116 and a shoe 118.

In the example of FIG. 1, game table 100 is illustrated as accommodating seven players. In alternative examples, the game table accommodates a different number of players. In addition, although game table 100 can accommodate seven separate players at each of positions 112*a-g*, it is possible for fewer players to participate at game table 100 (e.g., from one to six). It is also possible for a single player to play at more than one position at game table 100, for example, where the single player playing hands at two or more of positions 112*a-g*.

In example aspects, the subject card game can be played with six to eight decks of cards with all 10 index cards removed (e.g., with one of all 10s, Jacks, Queens or Kings removed), with each deck having 48 cards without jokers and with backs of the same color and design. The card game is not limited to such, and can be played with a different number of decks (e.g., one or two decks), and can be played with a different type of deck (e.g., a standard 52-card deck). The cards are dealt by the dealer from shoe 118.

In example aspects, commencement of play can begin when the dealer (e.g., at position 110) announces "Place your bets, please," to one or more players at respective position(s) 112*a*-112*g*. Further, closing of bets shall take effect when the dealer announces "No more bets."

As noted above, players in the subject card game attempt to obtain a higher point total than the dealer without exceeding 21. In the example of FIG. 1, the fixed starting value for each hand and the dealer hand is an 8 of spades (e.g., as illustrated by starting values 108*a-h*). However, it should be noted that a different fixed starting value can be used (e.g., an 8 of clubs, hearts or diamonds, or a card with a different value than 8).

In example aspects, the fixed starting value is permanently imprinted on the layout of game table 100 (e.g., printed on the felt of game table 100). Alternatively, the fixed staring value is displayed on one or more screens integrated into the game table. For example, each of starting values 108*a*-108*h* can correspond to a display screen (e.g., monitor) which is programmed to display the fixed starting value as a virtual card.

In example aspects for the virtual card, the fixed starting value may be randomly selected for each round of play. For example, a random number generator (RNG) may generate a random virtual card to use for the fixed starting value based on one or more virtual card decks. In alternative example aspects for the virtual card, the fixed starting value (e.g., 8 of spades) is predetermined and permanent (e.g., set by a croupier or sponsor of the game such as a casino), and does not change between rounds of play.

Each of the players first places a main wager (e.g., at main wager areas 104*a-g*) before receiving a card. In addition, prior to the cards being dealt, each player may place one or more side wagers (e.g., at side wager area 106*a-g*). As shown in the example of FIG. 1, each of side wager areas 106 *a-g* includes a betting circle corresponding to an optional side wager. In alternative examples, a different number of betting circles (e.g., two or three) may be included in each of side wager areas 106*a-g* to correspond with respective optional side wagers.

In example aspects, the side wager can be referred to as a "Superb 8's" side wager. The Superb 8's side wager is placed in the betting circle of side wager area (e.g., 106*a-g*) and will win when at least the first card dealt to the player is an 8 (e.g., or matches the starting value, if the starting value is different than 8), even if the player loses for his/her main wager. The betting circle may include an imprint signifying that the circle corresponds to the Superb 8's side wager (or another type of side wager, if applicable).

Alternatively or in addition, a bonus referred to as a "6-7-8 bonus" can be paid. The 6-7-8 bonus will pay, regardless of the outcome of the original main wager, if the first two cards drawn to the player's hand are a 6-card and a 7-card. For example, since the fixed starting value of 8 is included, the player must have a 6 and 7 as their first two cards drawn to receive the 6-7-8 bonus payout.

Once all initial wagers are placed, starting from the dealer's left and continuing clockwise, the dealer deals a card (e.g., from shoe 118) face up to each of main wager areas 104*a-g* containing a wager. Each player then decides whether to stand on the total of the card plus the starting value (e.g., 8), take one or more additional cards, split, surrender, or double.

With respect to splitting, when the initial card dealt to a betting area matches the starting value (e.g., an 8), the player may split the hand and receive additional cards on each of the hands that are split, provided that a wager on the second hand so formed is an amount equal to the original main wager for that player.

Regarding splitting, a player may not form more than four hands while splitting in any one betting area, in each round of play except that: (i) prior to the subsequent deal, a player may choose to surrender by giving up 50 percent of the player's original main wager; (ii) a player may elect to double by wagering an amount equal to or less than his original main wager (but not less than the table minimum) on: (ii-a) the first card dealt to him/her; or (ii-b) the first two cards of any split pair, with any doubled hand receiving only one additional card.

A player is permitted to stand on his/her own card (e.g., initial card), or may elect to receive additional cards if his point total is less than 21. A player who obtains a hard or soft total of 21 is not permitted to double or draw additional cards.

Where a player's point total exceeds 21, any main wager on that hand shall lose and the dealer shall immediately collect the cards from that hand and place them in the discard rack 116.

The point value of cards is similar to that of traditional twenty-one. In particular, an Ace has a value of 1 or 11 unless 11 would give a player or the dealer a point total in excess of 21. Any card from 2 to 9 inclusive has its face value, and any Jack, Queen or King has a value of 10.

In example aspects, when the subsequent deal to all players' hands has been completed, a dealer shall draw additional card(s) to himself/herself, provided that the dealer draws to 16 points and stands on 17 points. Except for the Superb 8's side wager and the 6-7-8 bonus, the outcome of the round of play is determined based on the point total of the player's hand compared to the point total of the dealer's hand.

In example aspects, settlement of wagers is as follows in Table 1:

TABLE 1

| Type Of Wager | Payout |
|---|---|
| Main Wager | 1 to 1 |
| 6-7-8 Bonus (Excluding All Spades) | 1 to 1 |
| 6-7-8 Bonus (All Spades) | 5 to 1 |
| **Superb 8's Side Wager** | **Pays** |
| Two 8's | 3 to 1 |
| Three 8's | 8 to 1 |
| Four 8's (Excluding All Spades) | 800 to 1 |
| Four 8's (All Spades) | 8000 to 1 |

With reference to Table 1, the permanent 8 of spades is included and all subsequent 8's must be dealt to the player in sequence. For the 6-7-8 bonus, the permanent 8 of spades is included so that the player must have a 6 and 7 as their first two cards drawn.

As noted above, a player shall win if the player has a point total greater than that of the dealer without exceeding 21, or the player has not surrendered or exceeded 21 and the dealer exceeds 21. Further, a player shall lose if the dealer has a point total greater than that of the player without exceeding 21, or the player's point total exceeded 21. A player shall stand-off if the player has the same point total as the dealer. The dealer at game table 100 provides appropriate payouts to winning players, and may use chip tray 102 in making those payouts.

By virtue of using 8 as the fixed starting card value, it is not possible for a player or dealer to obtain a blackjack. Furthermore, there is no starting value less than 10. As such, an insurance side bet (e.g., offered in traditional twenty-one to a player before the dealer checks his/her hole card) may not be offered. Further, the complexity of the betting strategy using 8 as the fixed starting value may be reduced relative to traditional twenty-one.

According to example aspects regarding irregularities during game play, if a foreign card is found in the course of a game, the current round of play is voided, and all results of the previous games will stand. Where the cards have been dealt incorrectly prior to any interim settlement taking place or subsequent deal commencing and the cards cannot be reconstructed, the round of play is voided. After the dealer has announced "No more bets," no wager may be placed or increased and any wager so placed or to the extent increased will be refused and/or will not be honored. Further, after the dealer has announced "No more bets," no wager may be withdrawn and any wager withdrawn shall be won or lost based on the game results.

Figure 2:
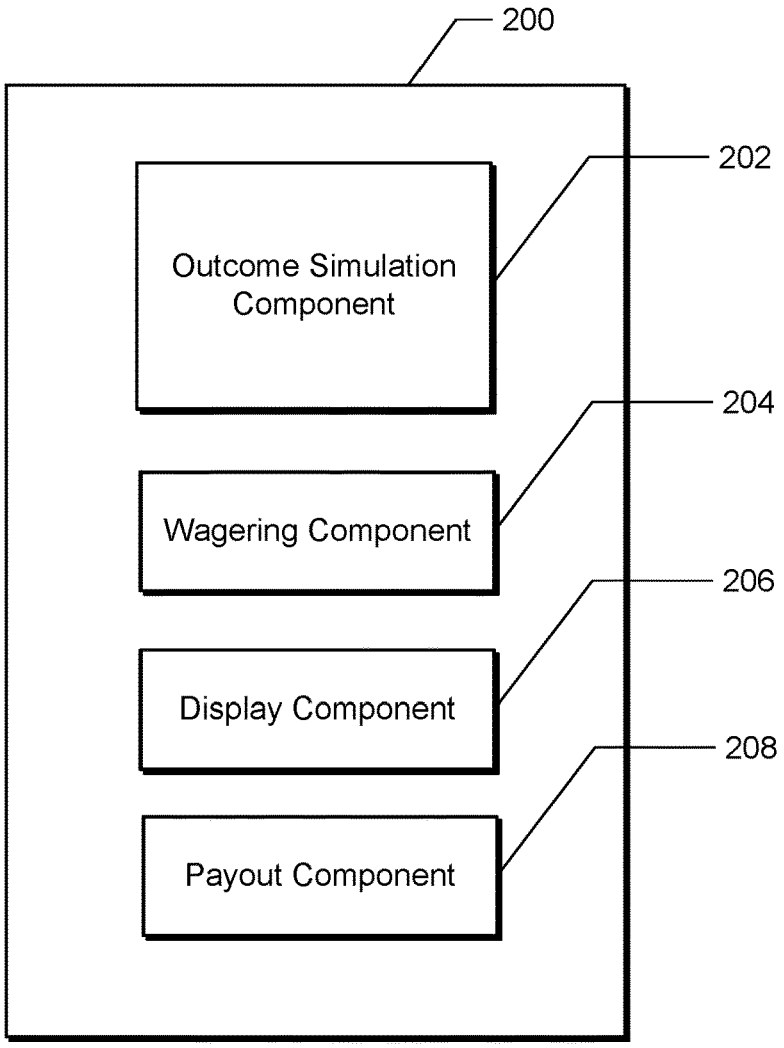
FIG. 2 illustrates an example apparatus for playing a virtual card game between a dealer and a player.

FIG. 2 illustrates an example apparatus for playing a virtual card game between a dealer and a player. The various components of the apparatus 200 may be implemented as a processor-based game console. For example, apparatus 200, may be a single console or terminal for allowing a single player to play a version of the subject card game, with the card game being simulated by software or firmware executing on apparatus 200.

Apparatus 200 may be implemented as a stand-alone unit with an RNG for dealing hands of the subject card game, the RNG being self-contained within an electronic gaming machine board and an individual cabinet. The one or more components of apparatus 200 may be communicatively coupled to one either via wired or wireless connection. In example embodiments, apparatus 200 can be a made up of multiple stations or terminals allowing multiple players to play a card game (e.g., twenty-one) being simulated by the apparatus 200, including for example, each player wagering on one or more potential game outcomes.

In alternative embodiments, apparatus 200 may be a client device in a client-server environment, including a client application for playing the card game in a virtual environment. In this manner, the client application may be installed at apparatus 200 and/or otherwise accessible at apparatus 200 by a user (e.g., through a browser or web-enabled component application installed on apparatus 200). Apparatus may be a mobile device (e.g., a smart-phone or notebook or tablet computer). The user may download the application onto apparatus 200 and/or access the application, for example, using a browser installed at apparatus 200.

Apparatus 200 includes game circuitry, which implements one or more of an outcome simulation component 202, a wagering component 204, a display component 206, and a payout component 208. Outcome simulation component 202 may randomly select cards from a randomized deck of virtual cards for use in the subject card game. In this regard, outcome simulation component 202 may include an RNG for simulating game outcomes (e.g., outcomes that the player can wager on).

For example, outcome simulation component 202 may include an electronic RNG for dealing of a set of cards used in the subject card game. The electronic RNG may generate, for example, random cards for a virtual table of the subject card game based on a virtual shoe of multiple card decks (e.g., six or eight decks). As cards are used, the RNG may remove the used cards from play so that they are not re-generated (e.g., in an eight deck shoe, after dealing the first Ace of spades, 7 more of this card would remain).

Outcome simulation component 202 may select a set of cards from one or more virtual decks according to a predetermined rule. Each deck may include a predetermined number of cards of a certain suit or values. In example embodiments, each virtual deck is a standard 52-card deck. In alternative embodiments, each virtual deck is formed by removing four cards (e.g., each of which is a 10 index card) from a standard 52-card deck, resulting in 48 cards per virtual deck. For example, the virtual deck may have one of: all four 10's removed, all four Jacks removed, all four Queens removed, or all four Kings removed. The total number of decks (e.g., 6 or 8) and the type of deck (e.g., 52-card deck or above-described 48-card deck) selected for a card game may be predetermined, for example, set by a croupier or sponsor of the game (e.g., by a casino).

Wagering component 204 may include or be associated with one or more wagering mechanisms for facilitating placing wagers (or "bets") on the possible outcomes of cards selected by outcome simulation unit 202. In some implementations, the wagering mechanisms may, for example, include one or more of machine implemented buttons, one or more touch screens or portions thereof, and/or include other machine-implemented mechanisms for placing wagers, initiating the dealing of a new set of cards, initiating rounds of play, and/or otherwise taking part in a game or round of play of the game simulated using apparatus 200. For example, FIGS. 3A-3B which are described in greater detail below, illustrate various examples of a graphical user interface for providing information about the subject card game to a player and/or facilitating play of the subject card game by way of virtual wagering mechanisms implemented as virtual buttons on a touch screen. Accordingly, these virtual wagering mechanisms may enable a single player to place wagers on potential outcomes related to cards generated by outcome simulation component 202 and/or selected by the player.

If the user is a new player, the user may be requested to provide information such as name, contact information, gaming preferences, and/or financial banking information. Such information may be used to create a user account used to conduct wagers for the card game. The account may be maintained in accordance with applicable requirements, rules and/or regulations for gaming and/or financial accounts.

Figure 3B:
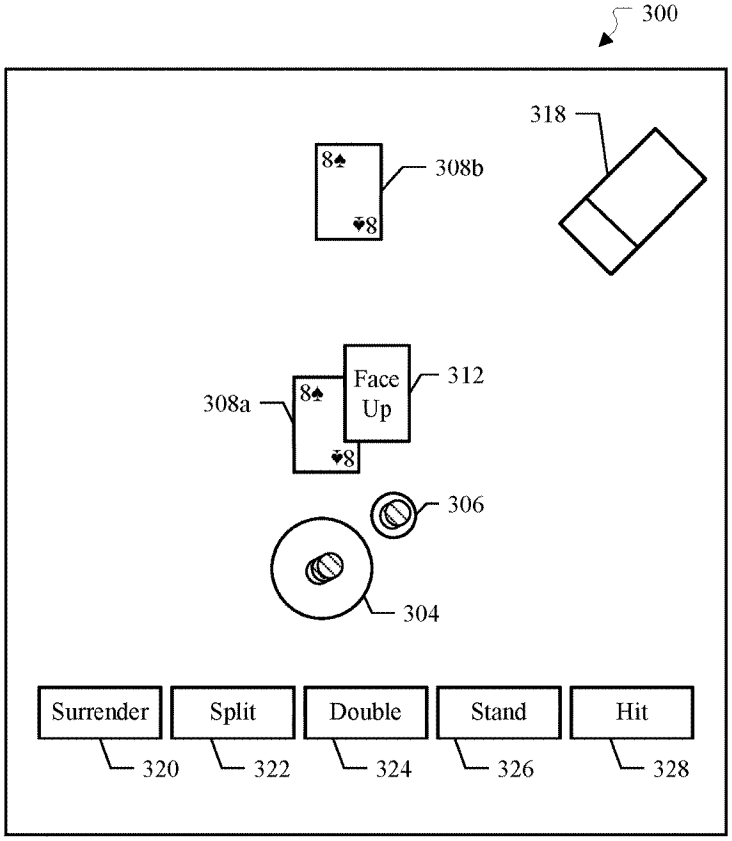
FIGS. 3A-3B illustrate an example of a graphical user interface for playing a virtual card game between a dealer and a player.
Figure 3A:
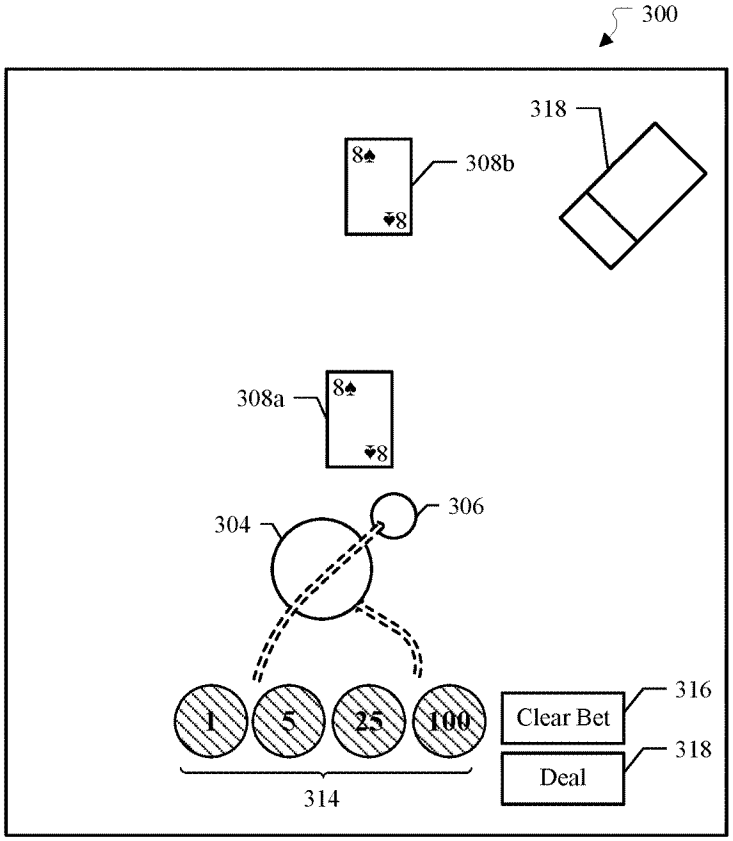

Display component 206 may include one or more displays for providing game-related information and graphics to the player. For example, display component 206 may include a main display for displaying game information such as game outcomes, wagering results, a visual representation of the randomizer unit(s) of the outcome simulation component 202, information and data from the outcome simulation component 202, hand history, and/or wagering information from the wagering component 204. Wagering component 204 and main display of display component 206 may be implemented as a graphical interface as depicted by FIGS. 3A-3B. In one or more implementations, display component 206 may include touch screen capabilities for allowing a player to place wagers.

In various aspects, display component 206 may include a main display and one or more secondary displays for displaying various images, videos or other visual indicia relating to the game, advertisements, marketing material, or other visual images or videos for display to the player. The main display and/or secondary display may include one or more of a touch screen display, a panel, a holographic display, a screen (e.g., LED or LCD) or other display. One or more displays of display component 206 (e.g., the main display and/or secondary displays) may include a tablet or other mobile display mechanism operably connected to apparatus 200 and used by the player.

Payout component 208, in one example, may be configured to settle wages placed, for example, using the wagering component 204, according to the outcome generated, for example, by the outcome simulation component 202. In one example, the wagering component may have access to data regarding particular returns for particular wagers relating to a specific game. In some examples, the payout component may further have access to rules and/or regulations regarding settling of wagers and/or payouts in one or more games. In one or more implementations, payout component 208 may be connected to and work in conjunction with an electronic voucher system for providing payout by printed voucher. Alternatively or in addition, payout component 208 may include or be operably connected to a physical payout dispenser or distributor for distribution of game tokens/cash to the player(s).

FIGS. 3A-3B illustrate an example of a graphical user interface for playing a virtual card game between a dealer and a player. Graphical user interface can be displayed on a display screen corresponding to apparatus 200, for virtual game play by a player. Graphical user interface 300 corresponds to a virtual game table, which includes a fixed starting value 308*b* corresponding to a position of a virtual dealer. The virtual game table of graphical user interface 300 further includes a fixed starting value 308*a*, main wager area 304 and side wager area 306, which correspond with a position of the player (e.g., at apparatus 200), with the player playing against the virtual dealer.

The virtual game table of graphical user interface 300 further includes a shoe 318 from which virtual cards can be dealt. In example aspects, the virtual dealer is displayed as a graphical representation of a person dealing the cards from shoe 318. Alternatively, the virtual dealer is not displayed at all, and virtual cards are simply displayed as being dealt from shoe 318.

In the example of FIGS. 3A-3B, graphical user interface 300 is illustrated as accommodating a single hand of the subject card game. Although not shown, it is possible for a single player to play multiple hands via graphical user interface 300, for example, with additional fixed starting value(s), main wager areas(s) and side wager area(s) being displayed for each additional hand.

In example aspects, the subject card game can be played with six to eight virtual decks of cards with all 10 index cards removed (e.g., with one of all 10s, Jacks, Queens or Kings removed), with each virtual deck having 48 cards without jokers and with backs of the same color and design. The virtual card game is not limited to such, and can be played with a different number of virtual decks (e.g., one or two decks), and can be played with a different type of deck (e.g., a standard 52-card deck). The virtual cards can be displayed as being dealt from shoe 318.

In example aspects, commencement of play can begin when the virtual dealer prompts the player to "place your bets, please" (e.g., via visual and/or audio cues). Further, closing of bets shall take effect when the virtual dealer announces "No more bets" (e.g., via visual and/or audio cues). The announcement of "No more bets" can be based on the expiration of a computer-based timer, e.g., implemented in apparatus 200 with a preset value (e.g., set by a croupier or sponsor of the game such as a casino).

As noted above, the player in the virtual card game attempts to obtain a higher point total than the virtual dealer without exceeding 21. In the example of FIGS. 3A-3B, the fixed starting card for each hand and the dealer hand is an 8 of spades (e.g., as illustrated by starting values 308*a*-*b*), which is displayed on graphical user interface 300. In alternative examples, a different starting value can be used (e.g., an 8 of clubs, hearts or diamonds, or a card with a value different than 8).

In example aspects, the fixed starting value may be randomly selected for each round of play. For example, an RNG may generate a random virtual card to use for the fixed starting value based on one or more virtual card decks (e.g., separate from the virtual decks used for dealing cards). In alternative example aspects, the fixed starting value (e.g., 8 of spades) for the displayed virtual card is predetermined and permanent (e.g., set by a croupier or sponsor of the game such as a casino), and does not change between rounds of play.

With reference to FIG. 3A, the player first places a main wager (e.g., at main wager area 304) before receiving a card. In addition, prior to the cards being dealt, the player may place one or more side wagers (e.g., at side wager area 306). As shown in the example of FIGS. 3A-3B, side wager area 306 includes a betting circle corresponding to an optional side wager. In alternative examples, a different number of betting circles (e.g., two, three) may be included in side wager area 306 to correspond with respective optional side wagers.

In example aspects, the side wager can be the Superb 8's side wager. The Superb 8's side wager is placed in the betting circle for side wager area (e.g., 306) and will win when at least the first card dealt to the player is an 8 (e.g., or matches the starting value, if the starting value is different than 8), even if the player loses for his/her main wager. The betting circle within graphical user interface 300 may display an indication that the circle corresponds to the Superb 8's side wager (or another type of side wager, if applicable).

Alternatively or in addition, the 6-7-8 bonus can be paid. The 6-7-8 bonus will pay, regardless of the outcome of the original main wager, if the first two cards drawn to the player's hand are a 6-card and a 7-card. For example, since the fixed starting value of 8 is included, the player must have a 6 and 7 as their first two cards drawn to receive the 6-7-8 bonus payout.

To place the wagers, the player may select (e.g., via touch input in association with graphical interface 300) the desired wager amount using one or more chips from chip selection interface 314. In example aspects, the user can tap or drag respective chip values onto main wager area 304, or onto the betting circle of side wager area 306. If the player wishes to clear his wagers, he/she may do so via clear bet button 316. Otherwise, once the player has finalized his/her wagers, he/she may select deal button 318, signifying the virtual dealer to deal the initial cards for the player and the dealer. Alternatively or in addition, the virtual dealer may be signaled to deal the initial cards after expiration of a timer (e.g., which can be displayed in graphical interface 300).

With respect to FIG. 3B, once the virtual dealer is signaled to deal the initial cards, the dealer deals a virtual card 312 from shoe 318 face up to main wager area 304. The player then decides whether to stand (e.g., via stand button 326) on the total of the card 312 plus the starting value (e.g., 8), take one or more additional cards (e.g., via hit button 328), split (e.g., via split button 322), surrender (e.g., via surrender button 320), or double (e.g., via double button 324).

With respect to splitting, when the initial card dealt to a betting area matches the starting value (e.g., an 8), the player may split the hand and receive additional cards on each of the hands that are split, provided that a wager on the second hand so formed is an amount equal to the original main wager for that player.

Regarding splitting, a player may not form more than four hands while splitting in any one betting area, in each round of play except that: (i) prior to the subsequent deal, a player may choose to surrender by giving up 50 percent of the player's original main wager; (ii) a player may elect to double by wagering an amount equal to or less than his original main wager (but not less than the table minimum) on: (ii-a) the first card dealt to him/her; or (ii-b) the first two cards of any split pair, with any doubled hand receiving only one additional card.

A player is permitted to stand on his/her own card (e.g., initial card), or may elect to receive additional cards if his point total is less than 21. A player who obtains a hard or soft total of 21 is not permitted to double or draw additional cards.

Where a player's point total exceeds 21, any main wager on that hand shall lose and the virtual dealer shall immediately collect the cards from that hand and place them in the discard rack 316.

As noted above, the point value of cards is similar to that of traditional twenty-one. In particular, an Ace has a value of 1 or 31 unless 31 would give a player or the dealer a point total in excess of 21. Any card from 2 to 9 inclusive has its face value, and any Jack, Queen or King has a value of 30.

In example aspects, when the subsequent deal to the player's hand has been completed, the virtual dealer shall draw additional card(s) to himself/herself, provided that the dealer draws to 16 points and stands on 17 points. Except for the Superb 8's side wager and 6-7-8 bonus, the outcome of the round of play is determined based on the point total of the player's hand compared to the point total of the dealer's hand.

In example aspects, settlement of wagers is based on Table 1 as described above with respect to FIG. 1. The permanent 8 of spades is included and all subsequent 8's must be dealt to the player in sequence. For the 6-7-8 bonus, the permanent 8 of spades is included so that the player must have a 6 and 7 as their first two cards drawn.

As noted above, a player shall win if the player has a point total greater than that of the dealer without exceeding 21, or the player has not surrendered or exceeded 21 and the dealer exceeds 21. Further, a player shall lose if the dealer has a point total greater than that of the player without exceeding 21, or the player's point total exceeded 21. A player shall stand-off if the player has the same point total as the dealer. The dealer at game table 100 provides appropriate payouts to winning players, and may use chip tray 102 in making those payouts.

By virtue of using 8 as the fixed starting card value, it is not possible for a player or dealer to obtain a blackjack. Furthermore, there is no starting value less than 10. As such, an insurance side bet (e.g., offered in traditional twenty-one to a player before the dealer checks his/her hole card) may not be offered. Further, the complexity of the betting strategy using 8 as the fixed starting value may be reduced relative to traditional twenty-one.

After the dealer has announced "No more bets," graphical user interface 300 prohibits any wager from being placed or increased (e.g., by disabling the appropriate interface elements/buttons, such as chip selection interface 314). Further, after the dealer has announced "No more bets" (e.g., in association with the above-noted timer), graphical user interface 300 prohibits withdrawing any placed bet (e.g., by disabling the appropriate elements/buttons, such as clear bet button 316).

Figure 4:
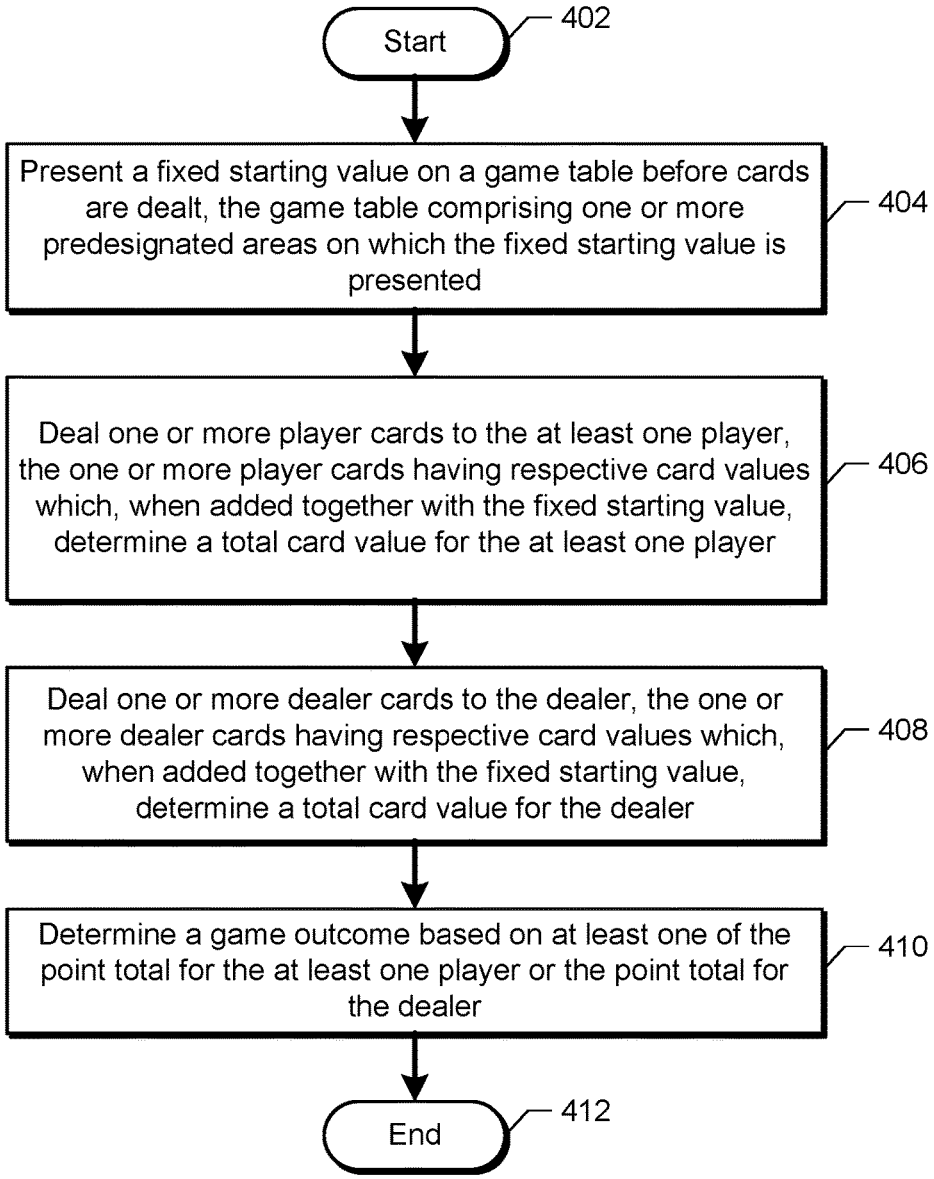
FIG. 4 illustrates an example process by which a card game is played between a dealer and at least one player.

FIG. 4 illustrates an example process by which a card game is played between a dealer and at least one player. The cards of the card game can comprise multiple standard 52-card decks. Alternatively, each of the multiple decks can formed by removing four cards, each of which is a 10 index card, from a standard 52-card deck.

Following start block 402, a fixed starting value is presented on a game table before cards are dealt at block 404. The game table comprises one or more predesignated areas on which the fixed starting value is presented.

The fixed starting value can be permanently imprinted on the game table at each of the one or more predesignated areas. Alternatively, the fixed starting value can be displayed on the game table using a respective display device at each of the one or more predesignated areas.

The one or more predesignated areas can respectively correspond to positions of the dealer and the at least one player at the game table. The fixed starting value can be 8, and can presented on the one or more predesignated areas as an 8 of spades.

At block 406, one or more player cards are dealt to the at least one player, the one or more player cards having respective card values which, when added together with the fixed starting value, determine a point total for the at least one player.

A main wager can be received from the at least one player before the cards are dealt, wherein payout for the main wager is based on the determined game outcome, and after dealing a first of the one or more player cards, the at least one player can be provided with an option to stand, take additional cards, split, double, or surrender.

The at least one player can be provided with an option to place a side wager before the cards are dealt, where payout for the side wager is based on the respective card value for at least the first of the one or more cards matching the fixed starting value.

At block 408, one or more dealer cards are dealt to the dealer, the one or more dealer cards having respective card values which, when added together with the fixed starting value, determine a point total for the dealer.

At block 410, a game outcome is determined based on at least one of the point total for the at least one player or the point total for the dealer. Determining the game outcome can be based on comparing the point total for the at least one player with the point total for the dealer. Alternatively or in addition, determining the game outcome can be based on the point total for the at least one player exceeding 21, or based on the point total for the dealer exceeding 21. The process ends at end block 412.

Figure 5:
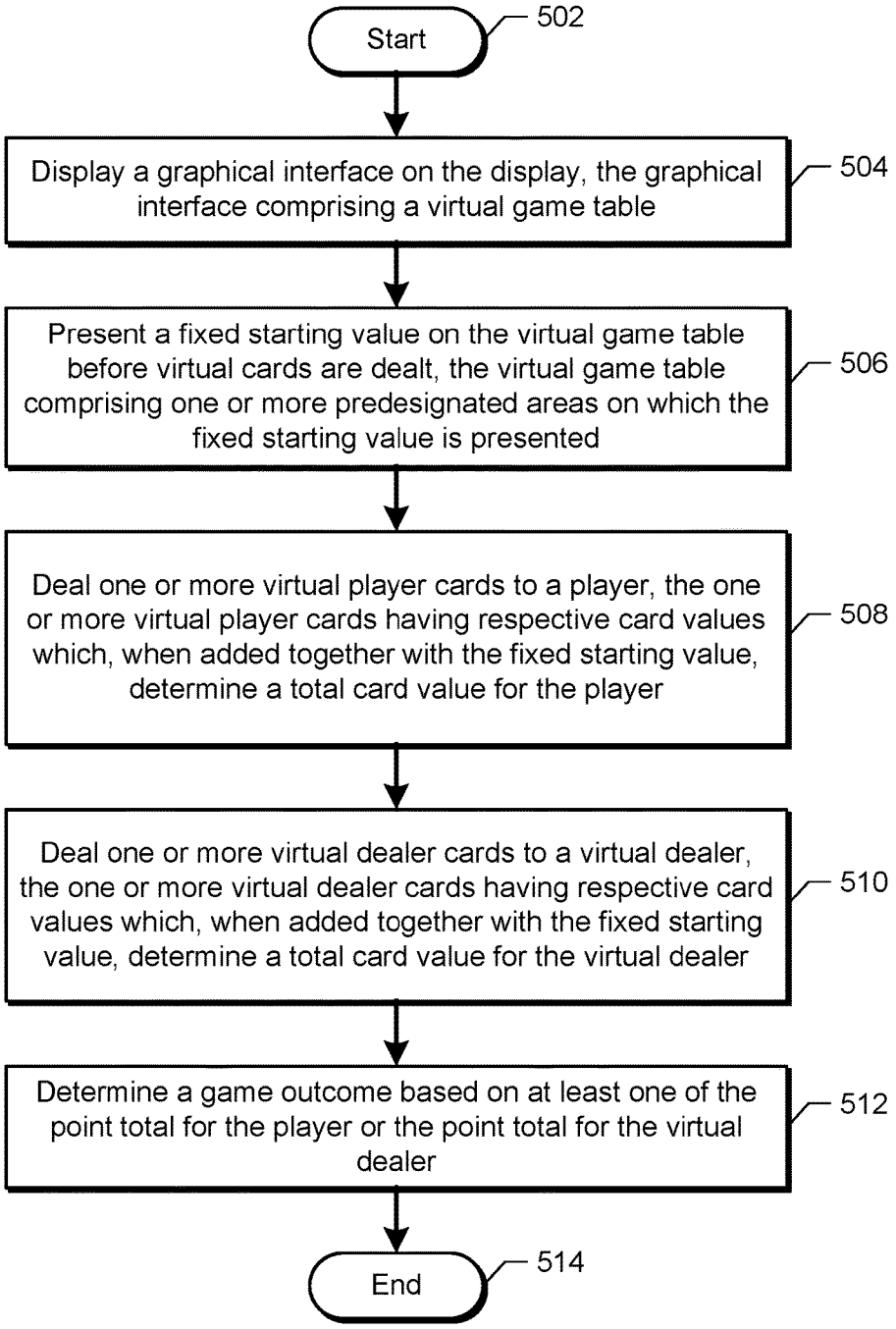
FIG. 5 illustrates another example process by which a card game is played between a dealer and at least one player.

FIG. 5 illustrates another example process by which a card game is played between a dealer and at least one player. The virtual cards can comprise multiple standard 52-card decks. Alternatively, each of the multiple decks can be formed by removing four cards, each of which is a 10 index card, from a standard 52-card deck.

Following start block 502, a graphical interface is displayed on the display device at block 504. The graphical interface comprises a virtual game table. At block 506, a fixed starting value is presented on the virtual game table before virtual cards are dealt. The virtual game table comprises one or more predesignated areas on which the fixed starting value is presented.

At block 508, one or more virtual player cards are dealt to a player, the one or more virtual player cards having respective card values which, when added together with the fixed starting value, determine a point total for the player.

A main wager can be received from the player before the virtual cards are dealt, wherein payout for the main wager is based on the determined game outcome. Via the graphical interface and after dealing a first of the one or more virtual player cards, the player can be provided with an option to stand, take additional cards, split, double, or surrender.

Via the graphical interface, the player can be provided with an option to place a side wager before the virtual cards are dealt, where payout for the side wager is based on the respective card value for at least the first of the one or more cards matching the fixed starting value.

The fixed starting value can be presented on the virtual game table at each of the one or more predesignated areas. The one or more predesignated areas can respectively correspond to positions of the virtual dealer and the player at the virtual game table. The fixed starting value can be an 8, and can be presented on the one or more predesignated areas as an 8 of spades.

At block 510, one or more virtual dealer cards are dealt to a virtual dealer, the one or more virtual dealer cards having respective card values which, when added together with the fixed starting value, determine a point total for the virtual dealer.

At block 512, a game outcome is determined based on at least one of the point total for the player or the point total for the virtual dealer. Determining the game outcome can be based on comparing the point total for the player with the point total for the dealer. Alternatively or in addition, determining the game outcome can be based on the point total for the player exceeding 21, or based on the point total for the virtual dealer exceeding 21. The process ends at end block 514.

Figure 6:
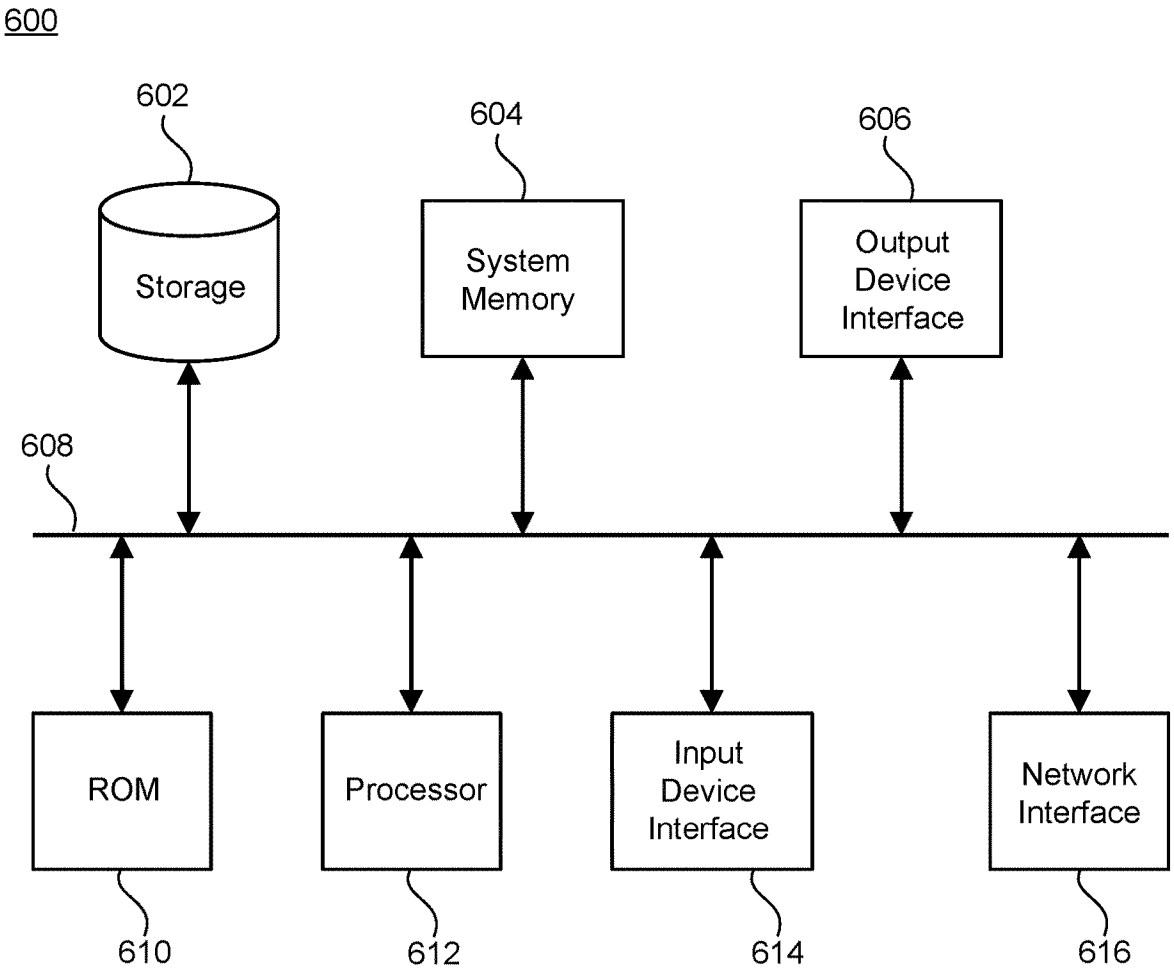
FIG. 6 conceptually illustrates an example electronic system with which some implementations of the subject technology can be implemented.

FIG. 6 conceptually illustrates an example electronic system with which some implementations of the subject technology can be implemented. Electronic system 600 can be a server, computer, phone, PDA, laptop, tablet computer, television with one or more processors embedded therein or coupled thereto, or any other sort of electronic device. Electronic system 600 may be representative of a client device, server, and/or processor. Such an electronic system includes various types of computer readable media and interfaces for various other types of computer readable media. Electronic system 600 includes a bus 608, processing unit(s) 612, a system memory 604, a read-only memory (ROM) 610, a permanent storage device 602, an input device interface 614, an output device interface 606, and a network interface 616.

Bus 608 collectively represents all system, peripheral, and chipset buses that communicatively connect the numerous internal devices of electronic system 600. For instance, bus 608 communicatively connects processing unit(s) 612 with ROM 610, system memory 604, and permanent storage device 602.

From these various memory units, processing unit(s) 612 retrieves instructions to execute and data to process in order to execute the processes of the subject disclosure. The processing unit(s) can be a single processor or a multi-core processor in different implementations.

ROM 610 stores static data and instructions that are needed by processing unit(s) 612 and other modules of the electronic system. Permanent storage device 602, on the other hand, is a read-and-write memory device. This device is a non-volatile memory unit that stores instructions and data even when electronic system 600 is off. Some implementations of the subject disclosure use a mass-storage device (such as a magnetic or optical disk and its corresponding disk drive) as permanent storage device 602.

Other implementations use a removable storage device (such as a floppy disk, flash drive, and its corresponding disk drive) as permanent storage device 602. Like permanent storage device 602, system memory 604 is a read-and-write memory device. However, unlike storage device 602, system memory 604 is a volatile read-and-write memory, such a random access memory. System memory 604 stores some of the instructions and data that the processor needs at runtime. In some implementations, the processes of the subject disclosure are stored in system memory 604, permanent storage device 602, and/or ROM 610. For example, the various memory units include instructions for facilitating remote betting in live games according to various implementations. From these various memory units, processing unit(s) 612 retrieves instructions to execute and data to process in order to execute the processes of some implementations.

Bus 608 also connects to input and output device interfaces 614 and 606. Input device interface 614 enables the user to communicate information and select commands to the electronic system. Input devices used with input device interface 614 include, for example, alphanumeric keyboards and pointing devices (also called "cursor control devices"). Output device interfaces 606 enables, for example, the display of images generated by the electronic system 600. Output devices used with output device interface 606 include, for example, printers and display devices, such as cathode ray tubes (CRT) or liquid crystal displays (LCD). Some implementations include devices such as a touch-screen that functions as both input and output devices.

Finally, as shown in FIG. 6, bus 608 also couples electronic system 600 to a network (not shown) through a network interface 616. In this manner, the computer can be a part of a network of computers (such as a local area network ("LAN"), a wide area network ("WAN"), or an Intranet, or a network of networks, such as the Internet. Any or all components of electronic system 600 can be used in conjunction with the subject disclosure.

These functions described above can be implemented in digital electronic circuitry, in computer software, firmware or hardware. The techniques can be implemented using one or more computer program products. Programmable processors and computers can be included in or packaged as mobile devices. The processes and logic flows can be performed by one or more programmable processors and by one or more programmable logic circuitry. General and special purpose computing devices and storage devices can be interconnected through communication networks.

Some implementations include electronic components, such as microprocessors, storage and memory that store computer program instructions in a machine-readable or computer-readable medium (alternatively referred to as computer-readable storage media, machine-readable media, or machine-readable storage media). Some examples of such computer-readable media include RAM, ROM, read-only compact discs (CD-ROM), recordable compact discs (CD-R), rewritable compact discs (CD-RW), read-only digital versatile discs (e.g., DVD-ROM, dual-layer DVD-ROM), a variety of recordable/rewritable DVDs (e.g., DVD-RAM, DVD-RW, DVD+RW, etc.), flash memory (e.g., SD cards, mini-SD cards, micro-SD cards, etc.), magnetic and/or solid state hard drives, read-only and recordable Blu-Ray® discs, ultra density optical discs, any other optical or magnetic media, and floppy disks. The computer-readable media can store a computer program that is executable by at least one processing unit and includes sets of instructions for performing various operations. Examples of computer programs or computer code include machine code, such as is produced by a compiler, and files including higher-level code that are executed by a computer, an electronic component, or a microprocessor using an interpreter.

While the above discussion primarily refers to microprocessor or multi-core processors that execute software, some implementations are performed by one or more integrated circuits, such as application specific integrated circuits (ASICs) or field programmable gate arrays (FPGAs). In some implementations, such integrated circuits execute instructions that are stored on the circuit itself.

As used in this specification and any claims of this application, the terms "computer", "server", "processor", and "memory" all refer to electronic or other technological devices. These terms exclude people or groups of people. For the purposes of the specification, the terms display or displaying means displaying on an electronic device. As used in this specification and any claims of this application, the terms "computer readable medium" and "computer readable media" are entirely restricted to tangible, physical objects that store information in a form that is readable by a computer. These terms exclude any wireless signals, wired download signals, and any other ephemeral signals.

To provide for interaction with a user, implementations of the subject matter described in this specification can be implemented on a computer having a display device, e.g., a CRT (cathode ray tube) or LCD (liquid crystal display) monitor, for displaying information to the user and a keyboard and a pointing device, e.g., a mouse or a trackball, by which the user can provide input to the computer. Other kinds of devices can be used to provide for interaction with a user as well; for example, feedback provided to the user can be any form of sensory feedback, e.g., visual feedback, auditory feedback, or tactile feedback; and input from the user can be received in any form, including acoustic, speech, or tactile input. In addition, a computer can interact with a user by sending documents to and receiving documents from a device that is used by the user; for example, by sending web pages to a web browser on a user's client device in response to requests received from the web browser.

Implementations of the subject matter described in this specification can be implemented in a computing system that includes a back end component, e.g., as a data server, or that includes a middleware component, e.g., an application server, or that includes a front end component, e.g., a client computer having a graphical user interface or a Web browser through which a user can interact with an implementation of the subject matter described in this specification, or any combination of one or more such back end, middleware, or front end components. The components of the system can be interconnected by any form or medium of digital data communication, e.g., a communication network. Examples of communication networks include a local area network ("LAN") and a wide area network ("WAN"), an internetwork (e.g., the Internet), and peer-to-peer networks (e.g., ad hoc peer-to-peer networks).

The computing system can include clients and servers. A client and server are generally remote from each other and typically interact through a communication network. The relationship of client and server arises by virtue of computer programs running on the respective computers and having a client-server relationship to each other. In some implementations, a server transmits data (e.g., an HTML page) to a client device (e.g., for purposes of displaying data to and receiving user input from a user interacting with the client device). Data generated at the client device (e.g., a result of the user interaction) can be received from the client device at the server.

It is understood that any specific order or hierarchy of steps in the processes disclosed is an illustration of example approaches. Based upon design preferences, it is understood that the specific order or hierarchy of steps in the processes may be rearranged, or that some illustrated steps may not be performed. Some of the steps may be performed simultaneously. For example, in certain circumstances, multitasking and parallel processing may be advantageous. Moreover, the separation of various system components in the implementations described above should not be understood as requiring such separation in all implementations, and it should be understood that the described program components and systems can generally be integrated together in a single software product or packaged into multiple software products.

The previous description is provided to enable any person skilled in the art to practice the various aspects described herein. Various modifications to these aspects will be readily apparent to those skilled in the art, and the generic principles defined herein may be applied to other aspects. Thus, the claims are not intended to be limited to the aspects shown herein, but are to be accorded the full scope consistent with the language claims, where reference to an element in the singular is not intended to mean "one and only one" unless specifically so stated, but rather "one or more." Unless specifically stated otherwise, the term "some" refers to one or more. Pronouns in the masculine (e.g., his) include the feminine and neuter gender (e.g., her and its) and vice versa. Headings and subheadings, if any, are used for convenience only and do not limit the subject disclosure.

A phrase such as an "aspect" does not imply that such aspect is essential to the subject technology or that such aspect applies to all configurations of the subject technology. A disclosure relating to an aspect may apply to all configurations, or one or more configurations. A phrase such as an aspect may refer to one or more aspects and vice versa. A phrase such as a "configuration" does not imply that such configuration is essential to the subject technology or that such configuration applies to all configurations of the subject technology. A disclosure relating to a configuration may apply to all configurations, or one or more configurations. A phrase such as a configuration may refer to one or more configurations and vice versa.

The word "exemplary" is used herein to mean "serving as an example or illustration." Any aspect or design described herein as "exemplary" is not necessarily to be construed as preferred or advantageous over other aspects or designs.

What is claimed is:

1. A method of playing a card game between a dealer and at least one player, the method comprising:

presenting a fixed starting value on a game table before cards are dealt, the game table comprising one or more predesignated areas on which the fixed starting value is presented, wherein the fixed starting value is displayed as a card value on the game table, using a respective display device at each of the one or more predesignated areas;

dealing one or more player cards to the at least one player, the one or more player cards having respective card values which, when added together with the fixed starting value, determine a point total for the at least one player;

dealing one or more dealer cards to the dealer, the one or more dealer cards having respective card values which, when added together with the fixed starting value, determine a point total for the dealer;

determining a game outcome based on at least one of the point total for the at least one player or the point total for the dealer;

receiving a main wager from the at least one player before the cards are dealt, wherein payout for the main wager is based on the determined game outcome; and providing, after dealing a first of the one or more player cards, the at least one player with an option to stand, take additional cards, split, double, or surrender.

2. The method of claim 1, wherein the fixed starting value is permanently imprinted on the game table at each of the one or more predesignated areas.

3. The method of claim 1, wherein the one or more predesignated areas respectively correspond to positions of the dealer and the at least one player at the game table.

4. The method of claim 1, wherein the fixed starting value is 8.

5. The method of claim 4, wherein the fixed starting value is presented on the one or more predesignated areas as an 8 of spades.

6. The method of claim 1, wherein the cards comprise multiple decks, each deck formed by removing four cards, each of which is a 10 index card, from a standard 52-card deck.

7. The method of claim 1, further comprising:

providing the at least one player with an option to place a side wager before the cards are dealt, wherein payout for the side wager is based on the respective card value for at least the first of the one or more cards matching the fixed starting value.

8. The method of claim 1, wherein determining the game outcome is based on comparing the point total for the at least one player with the point total for the dealer.

9. The method of claim 1, wherein determining the game outcome is based on the point total for the at least one player exceeding 21.

10. The method of claim 1, wherein determining the game outcome is based on the point total for the dealer exceeding 21.

11. A system for playing a virtual card game, comprising:

a display device;

one or more processors; and a non-transitory machine-readable medium comprising instructions stored therein, which when executed by the processors, cause the processors to perform operations comprising:

displaying a graphical interface on the display device, the graphical interface comprising a virtual game table;

presenting a fixed starting value on the virtual game table before virtual cards are dealt, the virtual game table comprising one or more predesignated areas on which the fixed starting value is presented;

dealing one or more virtual player cards to a player, the one or more virtual player cards having respective card values which, when added together with the fixed starting value, determine a point total for the player;

dealing one or more virtual dealer cards to a virtual dealer, the one or more virtual dealer cards having respective card values which, when added together with the fixed starting value, determine a point total for the virtual dealer;

determining a game outcome based on at least one of the point total for the player or the point total for the virtual dealer;

receiving a main wager from the player before the virtual cards are dealt, wherein payout for the main wager is based on the determined game outcome; and providing, via the graphical interface and after dealing a first of the one or more virtual player cards, the player with an option to stand, take additional cards, split, double, or surrender.

12. The system of claim 11, wherein the fixed starting value is presented as a card value on the virtual game table at each of the one or more predesignated areas.

13. The system of claim 11, wherein the one or more predesignated areas respectively correspond to positions of the virtual dealer and the player at the virtual game table.

14. The system of claim 11, wherein the fixed starting value is 8.

15. The system of claim 14, wherein the fixed starting value is presented on the one or more predesignated areas as an 8 of spades.

16. The system of claim 11, wherein the virtual cards comprise multiple decks, each deck formed by removing four cards, each of which is a 10 index card, from a standard 52-card deck.

17. The system of claim 11, further comprising:

providing, via the graphical interface, the player with an option to place a side wager before the virtual cards are dealt, wherein payout for the side wager is based on the respective card value for at least the first of the one or more cards matching the fixed starting value.

18. The system of claim 11, wherein determining the game outcome is based on comparing the point total for the player with the point total for the virtual dealer.

19. The system of claim 11, wherein determining the game outcome is based on the point total for the player exceeding 21.

20. The system of claim 11, wherein determining the game outcome is based on the point total for the virtual dealer exceeding 21.

* * * * *